US005078640A

United States Patent [19]

Berman

[11] Patent Number: 5,078,640

[45] Date of Patent: Jan. 7, 1992

[54] PLAYTHING USABLE AS A CRUTCH PAD

[76] Inventor: Erik M. Berman, 2813 Waterford Dr., Cinnaminson, N.J. 08077

[21] Appl. No.: 657,002

[22] Filed: Feb. 15, 1991

[51] Int. Cl.[5] ..... A63H 3/00; A63H 3/02; A61H 3/02

[52] U.S. Cl. ..... 446/72; 446/369; 135/73

[58] Field of Search ..... 135/65, 68, 71, 73; 446/71, 72, 73, 74, 76, 369, 370, 371, 372

[56] References Cited

U.S. PATENT DOCUMENTS

| | | | |
|---|---|---|---|
| 1,509,778 | 9/1924 | Raymond | 135/68 |
| 1,732,763 | 10/1929 | McKeag | 135/73 |
| 1,906,264 | 5/1933 | Higgins | 135/73 |
| 2,871,014 | 1/1959 | Benson | 446/73 |
| 3,737,196 | 6/1973 | Bodor | 446/73 X |
| 4,027,687 | 6/1977 | McGowan | 135/68 X |
| 4,203,233 | 5/1980 | Crane | 446/369 X |
| 4,413,442 | 11/1983 | McSweeney | 446/73 |
| 4,543,669 | 10/1985 | Katz | 446/369 X |
| 4,711,261 | 12/1987 | Rosenberg | 135/71 X |

FOREIGN PATENT DOCUMENTS

| | | | |
|---|---|---|---|
| 983156 | 6/1951 | France | 446/73 |

*Primary Examiner*—David N. Muir

*Attorney, Agent, or Firm*—Caesar, Rivise, Bernstein, Cohen & Pokotilow, Ltd.

[57] ABSTRACT

A plaything usable as a crutch pad includes an outer case and an inner compressible filler. The outer case includes walls defining a pocket for receiving an upper cross piece of a crutch therein. The combination of the plaything with a crutch also forms a part of the present invention.

22 Claims, 2 Drawing Sheets

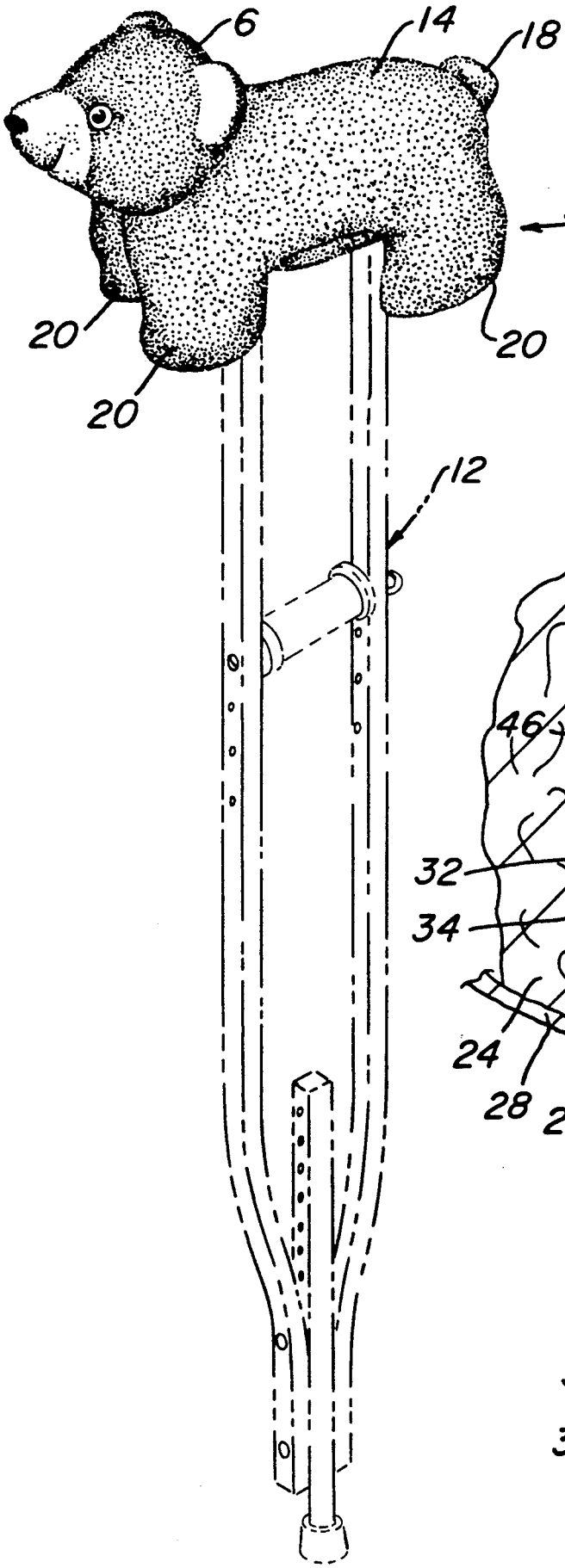
FIG. 1
FIG. 3
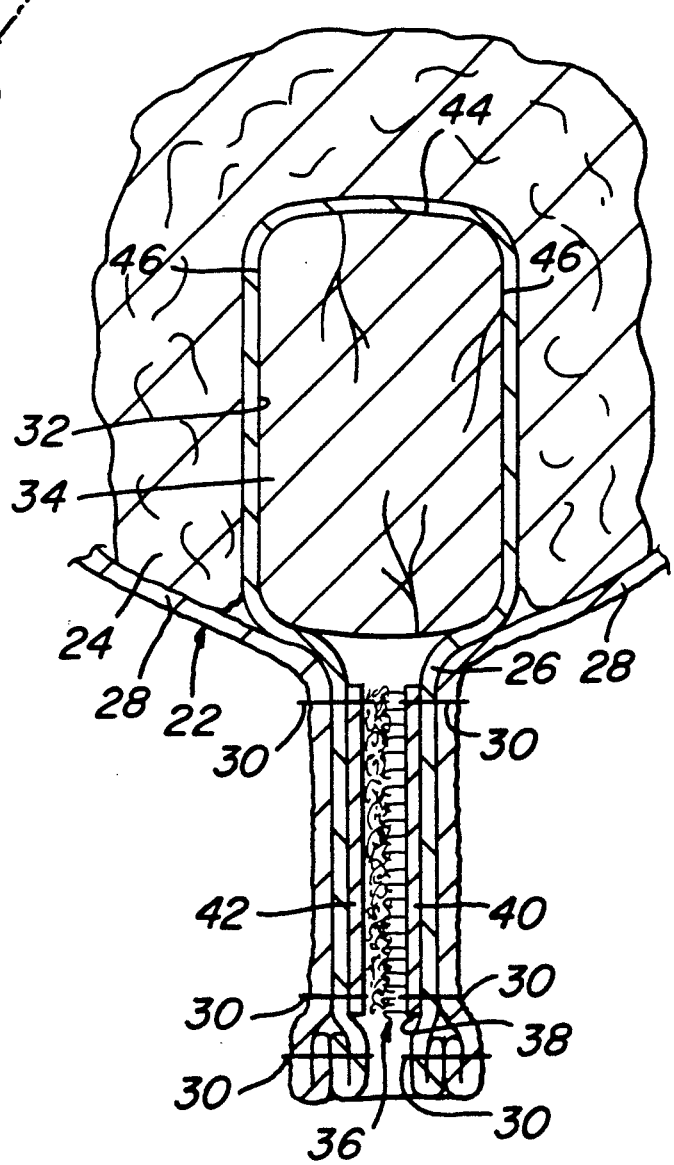

PLAYTHING USABLE AS A CRUTCH PAD

FIELD OF THE INVENTION

This invention relates to a plaything usable as a crutch pad and to the combination of the plaything with a crutch.

BACKGROUND ART

Padded crutch pads are commonly attached to the upper cross pieces of crutches to provide a soft, conforming structure in the underarm region of a person using the crutches. These products, while being generally acceptable often do not include sufficient padding to provide a comfortable structure for the user. Moreover, there is nothing particularly appealing about a crutch pad, to aid in improving the state of mind of a person requiring the use of crutches. To be able to improve the state of mind of a person requiring the use of crutches is a desirable attribute, particularly when that person is a child.

British Patent No. 425,676, issued to Masters, discloses a crutch pad having a removable outer cover with a zipper-type fastener. This arrangement permits the outer fabric cover to be removed easily, thereby permitting easy replacement of the underlying padding.

The U.S. Pat. Nos. to Theobald et al. (4,832,648), Perron (4,776,049), Mills (4,774,734), Spector (4,763,369), Chao-Yang (4,754,512), Swift (4,715,840), Frye (4,694,829), Schradermeier (2,591,379) and Sabaneeff (2,431,621), disclose a variety of useful articles (e.g., purses, bedding, head supports, sleeping bags and pillows) convertible into stuffed playthings or other toys. However, none of these patents disclose a plaything usable as a crutch pad.

OBJECTS OF THE INVENTION

It is a general object of this invention to provide an improved crutch pad for protecting the underarm region of a person requiring the use of crutches.

It is a further object of this invention to provide a crutch pad having uses in addition to protecting the underarm region of a person requiring the use of crutches.

It is a particular object of this invention to provide a plaything in the form of a compressible, three-dimensional article usable as a crutch pad to protect the underarm region of a person requiring the use of crutches.

It is a further object of this invention to provide a crutch pad having the capability of improving the state of mind of a person requiring the use of crutches.

SUMMARY OF THE INVENTION

The above and other objects of this invention are provided by a plaything usable as a crutch pad, wherein the plaything includes an outer case and an inner compressible filler. The outer case includes walls defining a pocket for receiving an upper cross piece of a crutch therein.

In a preferred embodiment of this invention the pocket of the plaything includes an open mouth insertable over the cross piece of the crutch and releasable fastener means adjacent the open mouth for closing the mouth with the cross piece of the crutch within the pocket. This aides in retaining the plaything on the cross piece.

Although the plaything may be in the form of an inanimate object, in the most preferred embodiment of this invention the plaything is in the form of an animate object, and most preferably is in the form of a stuffed animal.

Most preferably the pocket for receiving the cross piece of the crutch is provided in the belly of the stuffed animal, and the stuffed animal includes four legs adapted to straddle the cross piece when the plaything is attached to a crutch.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 1 is a isometric view of a plaything in accordance with this invention and illustrating, in phantom representation, a crutch attached to the plaything;

FIG. 3 is a sectional view taken along line 3—3 of FIG. 2.

DESCRIPTION OF THE PREFERRED EMBODIMENT OF THE INVENTION

Figure 2:
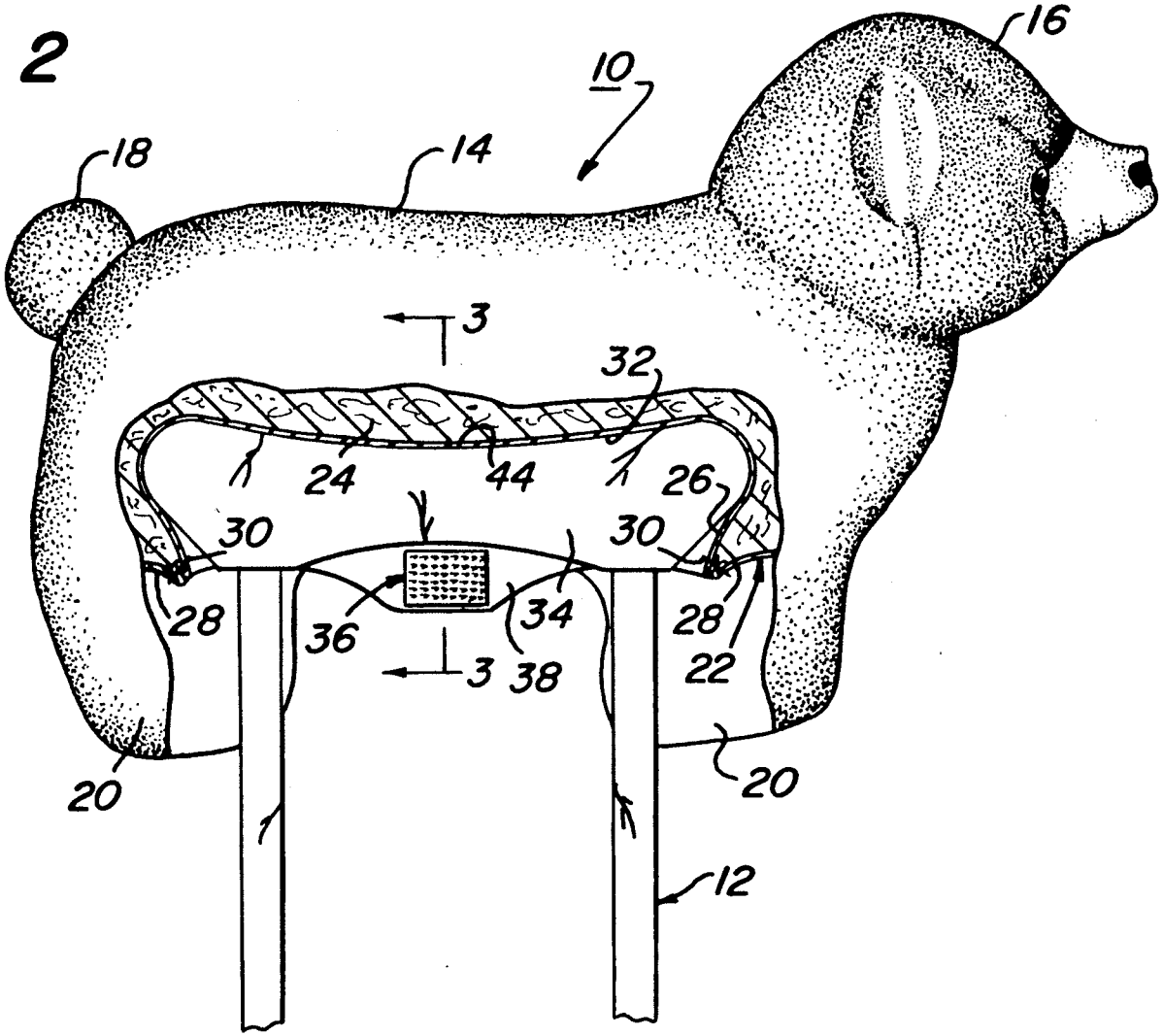
FIG. 2 is a side elevational view of the combination of the plaything and crutch with parts broken away to show details of the connection between the crutch and the plaything.

Referring now in greater detail to the various figures of the drawings, wherein like reference characters refer to like parts, a plaything usable as a crutch pad embodying the present invention is generally shown at 10 in FIG. 1. As is shown generally in FIG. 1 the plaything 10 is attachable to a crutch 12 for protecting and/or cushioning the underarm region of a person requiring the use of crutches.

Reference to "plaything" throughout this application, unless otherwise specifically limited, means a compressible, three-dimensional article that simulates, in either appearance or use, an animate object (e.g., an animal) or an inanimate object (e.g. a football) other than a crutch pad. The significance of the broadest aspect of this invention is that the plaything, although simulating, in either appearance or use, an animate or inanimate object other than a crutch pad is, in fact, usable as a crutch pad to provide very desirable cushioning of a person's underarm region.

Referring specifically to FIG. 1, the plaything in accordance with the preferred embodiment of the invention is an animate object, and preferably is in the form of a stuffed animal. In the illustrated embodiment the stuffed animal 10 is illustrated as being a bear having a body section 14, a head 16, a tail 18 and four legs 20.

Referring to FIGS. 2 and 3, the stuffed bear 10 includes an outer case 22 provided with a soft, compressible filler material 24. The outer case can be made of any desirable material, and most preferably, when the plaything is in the form of a stuffed animal, at least that portion of the outer case which is readily visible is made of a plush-like material to simulate the skin or fur of the animal. The soft, compressible filler 24 likewise can be made of any suitable material employed for stuffed animals, cushions and/or pillows.

It should be understood that the particular materials used to form the outer case 22 and the soft compressible filler 24 do not constitute limitations on the present invention, such materials being well known to people skilled in the art of manufacturing stuffed animals and other compressible objects, such as pillows and cushions. The outer case 22 is formed from a plurality of discrete panels which are sewn or stitched together in a conventional, well known manner.

Still referring to FIGS. 2 and 3, in the preferred embodiment of this invention a lower, inner panel 26 is secured to outer panel(s) 28 by conventional stitching 30 to define an inwardly facing pocket 32 in the belly of the animal. This pocket 32 is configured to receive an upper cross piece 34 of the crutch 12, to thereby locate the thick body section 14 of the animal in a position underlying the underarm of a user of the crutch. The relatively large quantity of compressible filler material 24 which can be located in the body section 14 of the animal provides for the very effective cushioning of the underarm region of the user.

As can be seen best in FIGS. 2 and 3, a fastener 36 is provided adjacent an open mouth 38 of the pocket 32, to permit the pocket to be closed about the cross piece 34. In the illustrated embodiment the fastener is a conventional VELCRO fastener having a first section 40 with hooks projecting therefrom for releasably attaching to loops of a second section 42. It should be understood that although VELCRO is illustrated as the preferred releasable fastener for use in this invention other fasteners can be used. The particular fastener employed to close the open mouth 38 of the pocket 32 does not constitute a limitation on the broadest aspects of this invention.

It also should be understood that although the material employed to form the readily observable portions of the outer case 22 preferably is a plush-like material to simulate the skin or fur of the animal, the lower, inner panel 26 preferably is made of a less expensive material that does not necessarily simulate the appearance of the animal's skin. The reason for this is that the inner panel 26 generally is not readily visible when the stuffed animal either is attached to the cross piece of the crutch or is otherwise being used or displayed as a stuffed animal, apart from its use as a crutch pad.

As can be seen best in FIGS. 2 and 3, the stuffed animal 10 is shown attached about a substantially conventional cross piece 34 of a crutch 12. In particular, the illustrated cross piece has a generally concave upper surface 44, as viewed in FIG. 2, and generally planar sidewalls 46, as viewed in FIG. 3. Although a conventionally shaped cross piece is illustrated in the drawings it should be understood that the plaything can be designed with a pocket for receiving a wide variety of different-shaped cross pieces, and the specific shape of the cross piece does not constitute a limitation of the present invention.

Without further elaboration the foregoing will so fully illustrate my invention that others may, by applying current or future knowledge, adopt the same for use under various conditions of service.

What is claimed as the invention is:

1. A stuffed animal having an alternative use as a crutch pad, said stuffed animal including an outer case and a compressible filler within the outer case for aiding in defining the shape of the stuffed animal, said outer case including walls defining a normally downwardly opening pocket sized and configured for receiving an upper cross piece of a crutch, and retaining means maintaining a crutch cross piece within said pocket with said compressible filler overlying said pocket providing cushioning for the underarm region of a user of a crutch, when an upper cross piece of a crutch is received within said pocket.

2. The stuffed animal of claim 1, wherein said normally downwardly opening pocket includes an open mouth insertable over an upper cross piece of a crutch, said open mouth including fastener means for retaining the plaything on an upper cross piece of a crutch received within said pocket.

3. The stuffed animal of claim 2 including the pocket in a belly thereof.

4. The stuffed animal of claim 3, including four legs adapted to straddle a cross piece of a crutch when a cross piece of a crutch is within the pocket, said legs including compressible filler therein.

5. The stuffed animal of claim 1 including the pocket in a belly thereof.

6. The stuffed animal of claim 5, including four legs adapted to straddle a cross piece of a crutch when a cross piece of a crutch is within the pocket, said legs including compressible filler therein.

7. A stuffed animal in combination with a crutch, said stuffed animal including an outer case and a compressible filler within the outer case for aiding in defining the shape of the stuffed animal, said outer case including walls defining a normally downwardly opening pocket sized and configured for receiving an upper cross piece of a crutch, an upper cross piece of a crutch disposed within said pocket, said compressible filler overlying said pocket for cushioning the underarm region of a user of the crutch.

8. The combination of claim 7, wherein said normally downwardly opening pocket includes fastener means for retaining the plaything on the upper cross piece of the crutch.

9. The combination of claim 8, wherein said stuffed animal includes a belly and the pocket is in said belly.

10. The combination of claim 9, wherein the stuffed animal includes four legs straddling the cross piece of the crutch, said legs including compressible filler therein.

11. The combination of claim 7, wherein said stuffed animal includes a belly and the pocket is in said belly.

12. The combination of claim 11, wherein the stuffed animal includes four legs straddling the cross piece of the crutch, said legs including compressible filler therein.

13. A plaything having an alternative use as a crutch pad, said plaything being a three-dimensional toy object including an outer case and a compressible filler within the outer case for aiding in defining the three-dimensional configuration of the toy object, said outer case including walls defining a normally downwardly opening pocket sized and configured for receiving an upper cross piece of a crutch, and closure means at said opening for closing the opening about an upper cross piece of a crutch while allowing crutch cross piece supports to pass through said opening so that said compressible filler overlying said pocket provides cushioning for the underarm region of a user of a crutch.

14. The plaything of claim 13, wherein said normally downwardly opening pocket includes an open mouth insertable over an upper cross piece of a crutch, said closure means including fastener means at the open mouth for retaining the plaything on an upper cross piece of a crutch received within said pocket.

15. The plaything of claim 14, wherein said fastener means is releasable for closing said mouth when a cross piece of a crutch is within the pocket to aid in retaining the plaything on a crutch.

16. The plaything of claim 14, in the form of an animate object.

17. The plaything of claim 13, in the form of an animate object.

18. A plaything in combination with a crutch, said plaything being a three-dimensional toy object including an outer case and a compressible filler within the outer case for aiding in defining the three-dimensional configuration of the toy object, said outer case including walls defining a normally downwardly opening pocket sized and configured for receiving an upper cross piece of a crutch therein, an upper cross piece of a crutch disposed within said pocket and retaining means for retaining the upper cross piece within said pocket with said compressible filler overlying said pocket for cushioning the underarm region of a user of the crutch.

19. The combination of claim 18, wherein the plaything is in the form of an animate object.

20. The combination of claim 18, wherein said retaining means includes fastening means adjacent an open mouth of said normally downwardly opening pocket for retaining the plaything on the upper cross piece of the crutch.

21. The combination of claim 20 wherein said fastener means is releasable for closing said mouth with the cross piece of the crutch within the pocket to aid in retaining the plaything on the cross piece.

22. The combination of claim 20, wherein the plaything is in the form of an animate object.

* * * * *